United States Patent [19]

Ronde

[11] 4,107,569

[45] Aug. 15, 1978

[54] COLOR SELECTION MEANS COMPRISING LENS ELECTRODES SPACED BY GRAINS OF INSULATING MATERIAL

[75] Inventor: Hubertus Joseph Ronde, Eindhoven, Netherlands

[73] Assignee: U.S. Philips Corporation, New York, N.Y.

[21] Appl. No.: 759,089

[22] Filed: Jan. 13, 1977

[30] Foreign Application Priority Data

Jan. 16, 1976 [NL] Netherlands ..... 7600420

[51] Int. Cl.[2] ..... H01J 29/07; H01J 19/30

[52] U.S. Cl. ..... 313/402; 313/355

[58] Field of Search ..... 313/402, 403, 408, 257, 313/268, 296, 297, 378, 460, 355, 456

[56] References Cited

U.S. PATENT DOCUMENTS

| | | | |
|---|---|---|---|
| 2,916,649 | 12/1959 | Levin | 313/250 |
| 3,243,655 | 3/1966 | Roxburgh | 313/257 X |
| 3,297,902 | 1/1967 | Beggs | 313/355 X |
| 3,435,274 | 3/1969 | Miller | 313/257 X |

*Primary Examiner*—Robert Segal

*Attorney, Agent, or Firm*—Frank R. Trifari; Algy Tomoshunas

[57] ABSTRACT

In an electrode assembly of at least two electrodes connected together in an insulating manner, said electrodes are kept at a defined distance by means of grains of an electrically insulating material. Said grains are sunk on two sides in layers of an adhesive material present on the facing surfaces of the electrodes and the sum of the thicknesses of which is smaller than the distance between the relevant electrodes.

3 Claims, 6 Drawing Figures

Figure 1:
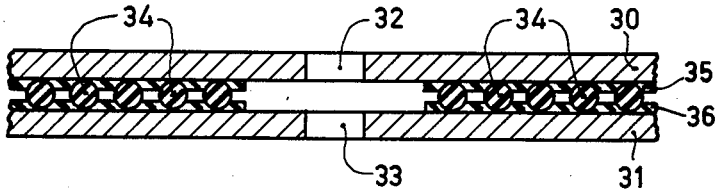

COLOR SELECTION MEANS COMPRISING LENS ELECTRODES SPACED BY GRAINS OF INSULATING MATERIAL

The invention relates to an electric discharge device comprising an assembly of at least two electrodes which are connected together in an insulating manner.

The invention relates in particular to a colour display tube comprising colour selection means which exert a post-focusing effect on the electron beams generated in the tube.

In the manufacture of electric discharge devices it frequently occurs that certain electrodes therein have to be assembled at a definite and often very small distance from each other. If these are electrodes between which during operation of the device a large voltage difference exists, high requirements are imposed upon the insulation material by means of which the electrodes are connected together. A particular problem, however, is that high-grade insulation materials, for example $Al_2O_3$ or other oxides, can in general not be used as such due to their necessarily high sintering temperature with respect to the melting point of the electrode material. Insulation materials that adhere to the electrode material at lower temperatures than the said oxides generally also have a lower insulation value, which makes the use of said materials for electrodes situated at a short distance from each other less suitable.

It is the object of the invention to provide an electric discharge device comprising an assembly of at least two electrodes situated at a short distance from each other and insulated electrically from each other by means of a high-grade insulation material.

According to the invention, the relevant electrodes are kept at a defined distance from each other by grains of an electrically insulating material present between the facing surfaces of the electrodes, which grains are sunk on two sides in layers of adhesive material present on the two surfaces of the electrodes, the sum of the thicknesses of said layers being smaller than the distance between the relevant electrodes.

The advantage of the invention is that both for the adhesion and for the insulation of the electrodes the materials most suitable for that purpose may be chosen. As a matter of fact, the insulation value of the adhesive material on the electrodes is of minor importance because the adhesive material on one electrode does not contact that on the other electrode and keeping the electrodes at a definite distance from each other is effected only by the grains of insulation material.

According as a greater accuracy in the distance between the electrodes is desired, the grains of insulation material have a more defined shape, for example, a cylindrical shape or a spherical shape.

It is to be noted that U.S. Pat. No. 2,916,649 discloses an electrode assembly in which adjacent electrodes are kept spaced apart by means of ceramic spacing members. The spacing members are kept in their places by cavities or holes in the electrodes, while the assembly is kept together by a compression spring. The accuracy in the distance between the electrodes not only depends on the tolerances in the dimensions of the spacing members but also on the tolerances in the dimensions of the cavities or holes in the electrodes. Furthermore, the use of pressure members to keep the electrode assembly together is not always possible and this known construction is less suitable when a small distance of, for example, less than 200 microns between the electrodes is desired.

The invention relates in particular to a colour display tube comprising selection means which exert a post-focusing effect on the electron beams generated in the tube. These colour selection means comprise a first and a second system of lens electrodes, a lens electrode belonging to the first system being connected to a lens electrode belonging to the second system in an insulating manner. Such a colour display tube of the post-focusing type is known from U.S. Pat. No. 3,398,309. in said specification a lens of the unipotential type is formed in each of the apertures of the colour selection means. For such lenses a rather great voltage difference between the electrodes forming the lens is required. The colour selection means consist of a metal apertured plate which provided on two sides with a layer of insulation material, a conductive layer being provided on the layers of insulation material. In this manner the colour selection means comprise a first, a second and a third system of lens electrodes. It is just in such colour selection means that the use of the present invention presents great advantages in connection with the freedom of choice with respect to the materials. According to the invention, a lens electrode belonging to a first system is maintained at a defined distance from a lens electrode belonging to a second system by means of grains of an electrically insulating material present between the facing surfaces of the electrodes, which grains are sunk on two sides in layers of an adhesive material present on the two said surfaces of the electrodes, the sum of the thicknesses of said layers being smaller than the distance between the relevant electrodes.

The colour selection means preferably comprise only two systems of lens electrodes in such manner that when a voltage difference is applied between the said two systems, a quadrupole lens is formed in each of the apertures of the colour selection means, the electric field of said lens being at right angles to or substantially at right angles to the electron beams passing through the aperture. In a preferred embodiment of said colour selection means a first system of electrodes is formed by a metal plate having apertures arranged according to rows and the second system of lens electrodes is formed by a grid of conductive strips connected together electrically, which plate, at least between the rows of apertures, and which strips, on the side facing the plate, are provided with a layer of adhesive material, which strips are positioned between the rows of apertures of the plate and are kept at a defined distance from the plate by grains of an electrically insulating material, said grains being partly sunk on one side in the layer of adhesive material present on the plate and being partly sunk on the other side in the layer of adhesive material present on the strips.

In another embodiment of the colour selection means the two systems of lens electrodes each consist of a grid of conductive strips which are connected together electrically, which grids cross each other and are kept at a defined distance from each other at the crossings by means of grains of an electrically insulating material present between the facing surfaces of the electrodes, which grains are sunk on two sides in layers of an adhesive material present on the two said surfaces of the electrodes, the sum of the thicknesses of said layers being smaller than the distance between the relevant electrodes.

At least one of the systems of lens electrodes preferably consists of a ferromagnetic material so as to screen the electron beams in the tube from the earth's magnetic field.

Figure 4:
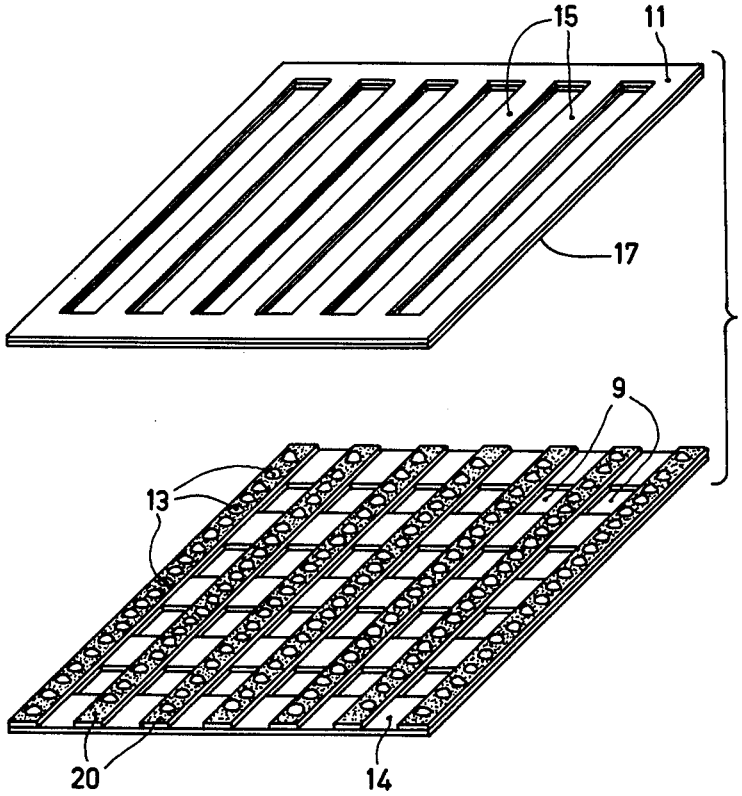
Figure 2:
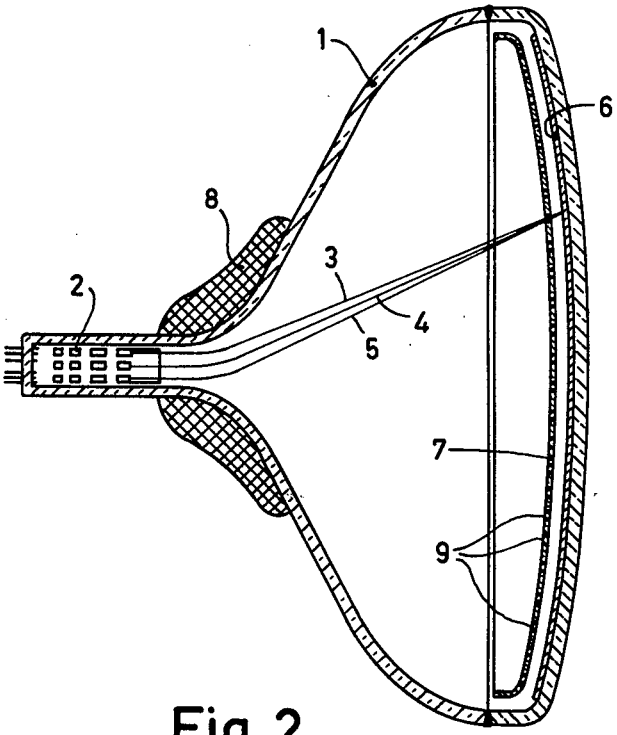
Figure 3:
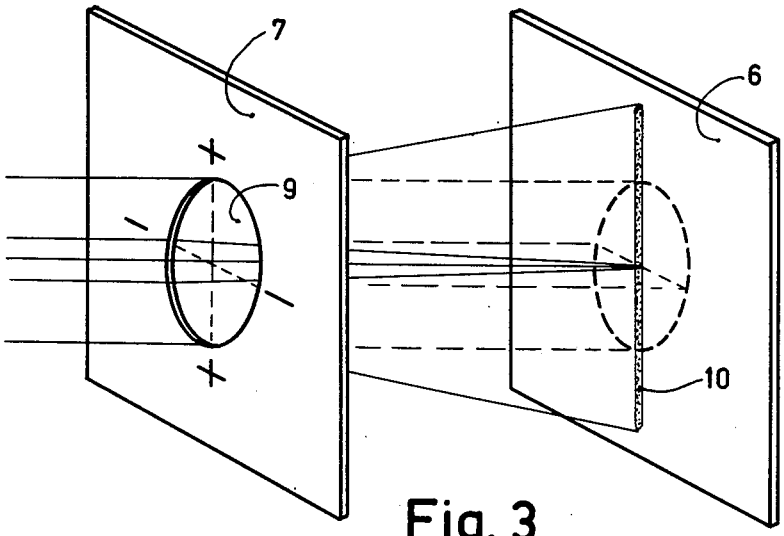
Figure 5:
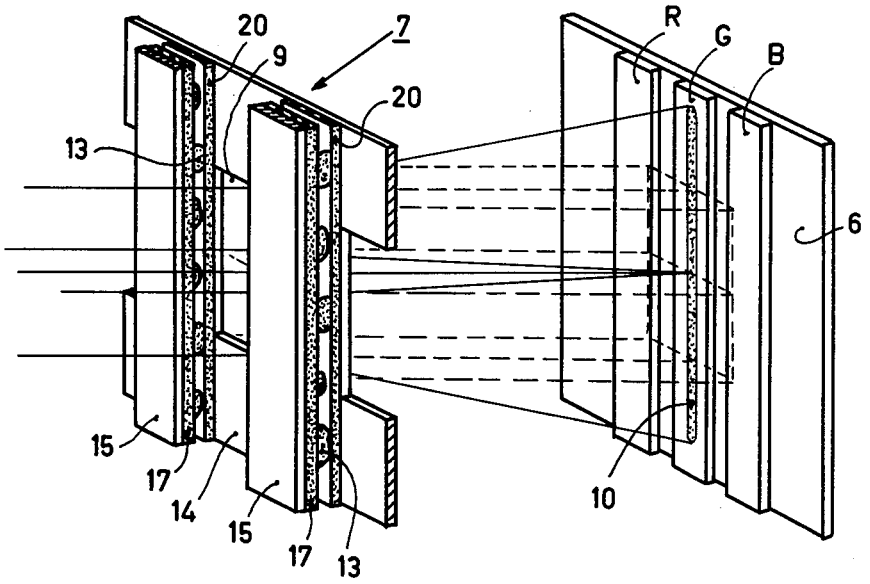
Figure 6:
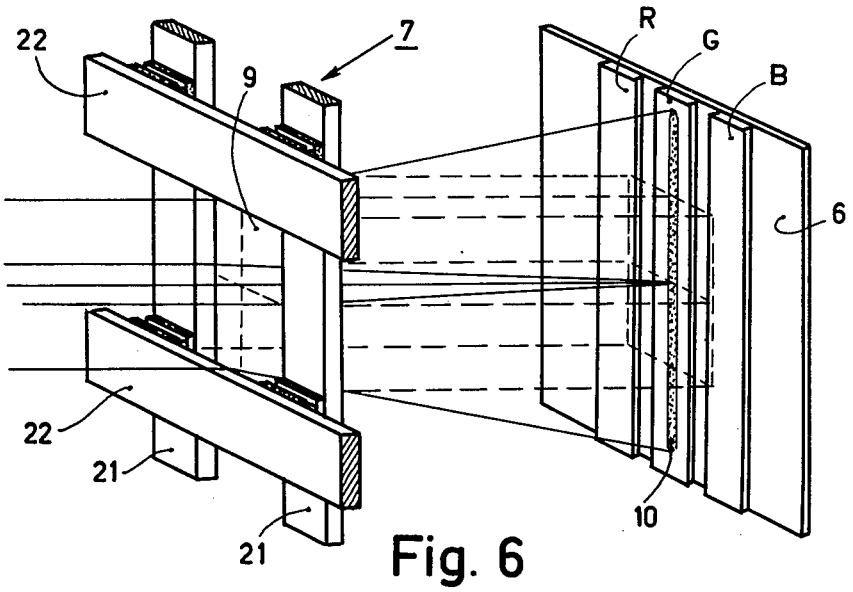

The invention will now be described in greater detail with reference to the drawings, in which:

FIG. 1 is a sectional view of an assembly of two electrodes connected together in an insulating manner according to the invention, FIG. 2 is a sectional view of a colour display tube having colour selection means consisting of two systems of lens electrodes connected together according to the invention, FIG. 3 illustrates the principle of the post-focusing effect of a quadrupole lens, FIG. 4 is an exploded view of an embodiment of colour selection means built up from two lens electrode systems, FIG. 5 shows a detail of the colour selection means shown in FIG. 4, and FIG. 6 shows a detail of another embodiment of the colour selection means.

The electrode assembly shown in FIG. 1 consists of a first electrode 30 and a second electrode 31 which form part, for example, of an electron gun not further shown. The two electrodes comprise apertures 32 and 33, respectively, for passing an electron beam. The electrode 30 is kept at a defined distance from the electrode 31 by spherical grains 34 having a diameter of 125 microns. Said grains consist of a high-grade insulation material, for example, aluminium oxide or beryllium oxide. The grains 34 are sunk on two sides in an adhesive material of which a layer 35, thickness approximately 20 microns, is present on the electrode 30 and a layer 36, thickness approximately 20 microns, is present on the electrode 31. A space of approximately 85 microns is present between said layers. Hence no high requirements are imposed upon the adhesive material as regards the electric insulation thereof. Suitable adhesive materials are, for example, methylmethacrylate resin, sealing glasses, for example lead glasses, and polymers, for example polystyrol, polyacrylate, polyvinyl and polyamides. Dependent on the type of adhesive material they may be provided in the form of suspensions, solutions or powder by means of spraying, pouring or settling. When the layers of adhesive material are to be provided in the form of a given pattern, methods known for that purpose may be used, for example, photographic methods. A process which may be used is as follows. A layer of adhesive material is provided in the desired thickness on one of the electrodes. Grains of insulation material having the size of the desired distance between the electrodes are provided on said adhesive layer by spraying or scattering. When a sealing glass is used as an adhesive material, the layer is heated to the softening point of the glass. The grains are pressed into the layer of adhesive material to such an extent that they contact the surface of the electrodes. Excessive grains are then removed by rinsing, spraying or brushing. A layer of adhesive material is also provided on the other electrode, after which said electrode is pressed against the grains adhering to the first electrode and the grains sink into said adhesive layer until they also contact the surface of said electrode and the assembly shown in FIG. 1 is obtained.

FIG. 2 shows a colour display tube having colour selection means composed of two electrode systems, which electrode systems are connected together according to the method described with reference to FIG. 1. The tube comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 2, and are deflected over the display screen 6 by means of the deflection coils 8. The display screen 6 consists of a large number of phosphor strips luminescing in red, green and blue and the longitudinal direction of which is at right angles to the plane of the drawing of FIG. 2. During normal operation of the tube the phosphor strips are vertical and FIG. 2 hence is a horizontal sectional view of the tube. The colour selection means 7 comprise a large number of apertures 9 in which a quadrupole lens is formed during operation of the tube. The three electron beams 3, 4 and 5 pass through the apertures 9 at a small angle with each other and consequently each impinge only upon phosphor strips of one colour. The apertures 9 in the colour selection means 7 are thus very accurately positioned relative to the phosphor strips of the display screen 6.

FIG. 3 shows the principle of the post-focusing effect of a quadrupole lens. Shown is a part of the colour selection means 7 and one of the apertures 9. The potential variation along the edge of the aperture 9 is denoted by +, −, +, − in such manner, that a quadrupole field is formed. The electron beam which passes through the aperture 9 is focused in the horizontally drawn plane and is defocused in the vertically drawn plane so that, when the display screen is exactly in the horizontal focus, the electron spot 10 is formed. As will be described hereinafter, it is recommendable not to focus exactly on the display screen 6 so that a slightly wider electron spot is obtained. It is only of minor influence on the focusing when the electron beam passed through the aperture 9 at a small angle. The colour selection of the three electron beams 3, 4 and 5 consequently takes place in a manner quite analogous to that of the known shadow mask tube. As a result of the strong post-focusing of the electron beams, however, the aperture 9 may be much larger than in the known shadow mask tube, so that a far greater number of electrons impinges upon the display screen 6 and a brighter picture is obtained. The defocusing in a vertical direction need not be any drawback when phosphor strips are used which are parallel to the longitudinal direction of the spot 10.

A first embodiment of the colour selection means 7 will be described with reference to FIG. 4. The starting materials for the manufacture of the colour selection means are a first iron plate 11 and a second iron plate 14. The two plates 11 and 14 have a thickness of 100 microns. By means of a known photoetching method, slots are etched in the plate 11 in such manner that a grid of parallel strips 15 is obtained. The strips have a width of 0.26 mm and the slots have a width of 0.54 mm. In the second iron plate 14 square holes 9 of 0.54 × 0.54 mm are etched with a pitch of 0.8 mm so that an apertured plate is obtained. The grid is covered on one side with an adhesive layer 17. 3 microns thick, consisting of the polyamide of 4-4'-diaminodiphenyl ether and 1-2-4-5 benezenetetracarbonic acid dianhydride. The apertured plate is also covered on one side with a 3 microns thick layer of the same adhesive material. By covering certain parts of the surface of the apertured plate temporarily with a photographically applied photolacquer, strips 20 of the adhesive material are obtained between the apertures 9. Said strips are scattered with spherical grains of $Al_2O_3$ of 100 microns denoted by 13, after which the grains not adhering to the strips 20 are removed by rinsing the plate. The grid is now pressed against the apertured plate, with the strips 15 positioned opposite to the strips 20, in which the $Al_2O_3$ grains keep the grid and the plate at a distance of 100 microns apart. The assembly is then heated in a furnace at a temperature of 350° C for approximately thirty minutes in a non-oxidizing atmosphere, the polyamide being converted into the polyimide of the said substances while expelling water. FIG. 5 shows a detail of the resulting colour selection means which after these operations can be moulded to the shape adapted to the display screen of the tube, for example a cylindrical shape. For the post-focusing of the electron beams of which FIG. 5 shows only the beam directed on the green-luminescing phosphor line G, the colour selection means can be operated at the following voltages. At a potential of the display screen 6 of 25 kV, a potential of the plate 14 of likewise 25 kV and a potential of the conductive strips 15 or 23.4 kV, the focal distance of the quadrupole lenses is 18 mm. with perpendicular incidence in the centre of the display screen and is 12.7 mm at the edge of the display screen where the electron beams are incident at an angle of 37° to the normal of the display screen. The distance between display screen 6 and the colour selection means 7 is 15 mm in the centre of the display screen and is 10 mm at the edge. The electron spots in the centre of the display screen then are 0.10 mm wide and in the corner they are 0.09 mm wide. The width of the phosphor strips R, G and B is 0.13 mm. The remainder of the display screen may or may not be provided with a light-absorbing material.

FIG. 6 shows another embodiment of the colour selection means 7. The two systems of lens electrodes consist of grids of parallel metal strips, 100 microns thick. Of the grid forming the first system of lens electrodes are shown two strips 21. Of the grid forming the second system of lens electrodes are shown two strips 22. The strips 21 and 22 cross each other at right angles and are connected together only at the crossings in a manner analogous to that described with reference to FIG. 4. Starting material are two grids coating on one side with a layer of adhesive material. After securing the grids together the excessive adhesive material may be removed by powder blasting. The insulation material at the crossings is not removed because at that area it is in the "shadow" of the conductors. The strips have a width of 0.24 mm and a mutual pitch of 0.80 mm so that the transmission of the colour selection means is approximately 50% and each of the apertures 9 forms a square of 0.56 × 0.56 mm. At a potential of the display screen 6 of 25 kV and a potential of the horizontal conductors 22 of 25.45 kV and of the vertical conductors 21 of 24.55 kV, the focal distance of the quadrupole lenses is 18.0 mm in the centre of the display screen with perpendicular incidence and is 12.7 mm at the edge of the curved display screen where the electron beams are incident at an angle of approximately 37° to the normal of the display screen. The distance of the colour selection means 7 to the display screen 6 is 15 mm in the centre and is 10 mm at the edge so that the focus of the quadrupole lenses is everywhere just slightly beyond the display screen to prevent that a so-called focus ring becomes visible on the display screen. The electron spots then are again approximately 0.10 mm wide, so that a suitable width of the phosphor strips R, G and B is again 0.13 mm.

What is claimed is:

1. A colour display tube comprising in an evacuated envelope means to generate a number of electron beams, a display screen comprising a large number of regions luminescing in different colours, and colour selection means having a large number of apertures which associate each electron beam with luminescent regions of one colour, which colour selection means comprise a first and a second system of lens electrodes, a lens electrode belonging to the first system being kept at a defined distance from a lens electrode belonging to the second system, characterized in that a lens electrode belonging to the first system is kept at a defined distance from a lens electrode belonging to the second system by means of grains of an electrically insulating material present between the facing surfaces of the electrodes, which grains are sunk on two sides in layers of an adhesive material present on the two said surfaces of the electrodes, the sum of the thicknesses of the said layers being smaller than the distance between the relevant electrodes.

2. A colour display tube as claimed in claim 1, characterized in that the first system of lens electrodes consists of a metal plate comprising apertures arranged according to rows and the second system of lens electrodes consists of a grid of conductive strips connected together electrically, which plate, at least between the rows of apertures, and which strips, on the side facing the plate, are provided with a layer of adhesive material, which strips are positioned between the rows of apertures of the plate and are kept at a defined distance from the plate by grains of an electrically insulating material, said grains being partly sunk on one side in the layer of adhesive material present on the plate and being partly sunk on the other side in the layer of adhesive material present on the strips.

3. A colour display tube as claimed in claim 1, characterized in that the two systems of lens electrodes consist of a grid of conductive strips connected together electrically, which grids cross each other and are kept at a defined distance from each other at the crossings by means of grains of an electrically insulating material present between the facing surfaces of the electrodes, which grains are sunk on two sides in layers of an adhesive material present on the two said surfaces of the electrodes, the sum of the thicknesses of said layers being smaller than the distance between the relevant electrodes.

* * * * *